United States Patent [19]

Fetty et al.

[11] 4,352,329

[45] Oct. 5, 1982

[54] TOY ROADWAY SYSTEM

[76] Inventors: Warren N. Fetty; Rosabelle M. Fetty, both of P.O. Box #306, Altadena, Calif. 91001

[21] Appl. No.: 142,001

[22] Filed: Apr. 21, 1980

[51] Int. Cl.[3] ..... B60L 15/00

[52] U.S. Cl. ..... 104/305; 46/1 K; 46/257; 104/DIG. 1; 238/10 F

[58] Field of Search ..... 104/53, 60, 295, 304, 104/305, DIG. 1; 238/10 R, 10 A, 10 E, 10 F; 46/1 K, 216, 253, 257, 259, 260, 258; 273/86 B

[56] References Cited

U.S. PATENT DOCUMENTS

| | | | |
|---|---|---|---|
| Re. 30,454 | 12/1980 | Birdsall | 104/305 |
| 2,387,859 | 10/1945 | Schmidt | 104/60 X |
| 2,836,129 | 5/1958 | Jaeger | 238/10 F X |
| 2,899,910 | 8/1959 | Vivari | 104/53 X |
| 3,120,719 | 2/1964 | Simonds | 46/216 X |
| 3,206,122 | 9/1965 | Frisbie et al. | 104/60 X |
| 3,288,368 | 11/1966 | Athearn | 238/10 F |
| 3,712,540 | 1/1973 | Yamasaki et al. | 238/10 E |
| 3,767,114 | 10/1973 | Rossi | 238/10 E |
| 4,241,875 | 12/1980 | Vandenbrink | 104/60 X |

FOREIGN PATENT DOCUMENTS

| | | | |
|---|---|---|---|
| 2056663 | 5/1972 | Fed. Rep. of Germany | 46/257 |
| 2549185 | 5/1976 | Fed. Rep. of Germany | 238/10 A |
| 563291 | 8/1944 | United Kingdom | 238/10 R |

*Primary Examiner*—Randolph A. Reese

[57] ABSTRACT

A miniature roadway system of the support type for vehicles such as cars and the like. The roadway consists of an elongated flat strip or length of plastic extrusion having flat thin flexible metal conductors slidably located in flanged recesses, molded longitudinal in one flat side of strip or length. The coilable and flexible roadway of relatively long length is uncoiled and flat-mounted on flat surfaces with the conductive bands exposed in the flanged channel recesses extending the length of the traction surface and is self-supporting.

In use, the long sections of highly flexible roadway are combined with turn sections and are set up in an unlimited number of endless configurations and elevations.

In use, the roadway is arranged either in a self-supporting configuration on the floor, patio, grass lawns and the like or utilizing special supports which engage recessed channels, molded into each side of roadway strip.

The vehicle utilizes a pair of shaped contacts to make electrical connections with the metallic conductors and a pair of drive wheels mounted on gear driven axle for gripping the traction surface of the roadway at a point on each side of channeled conductor locations.

21 Claims, 16 Drawing Figures

277
21
25
21
276
11
20
18
275
22
285
29
28
278
21
17
13
14
22
19
23
24
279
23
24
10
22
23
24
280
27
26
281
23
24
22
284
25
16
12
15
282
21
283
21

11
15
18
14
36
20
37
41
16-17
44
43
35
19
12-13
40

11
37
35
20
38
36
39
12-13
16-17
19

TOY ROADWAY SYSTEM

DESCRIPTION OF THE PRIOR ART

The present invention pertains to a toy vehicle system and specifically operating on a roadway system of a highly flexible type, which uses an elongated molded extrusion roadway member of relatively flexible non-conductive plastic material having electrically conductive thin flat flexible metal bands slidably mounted in two open flanged channels, moulded into flat upper roadbed surface of roadway.

The prior art contains a number of examples of toy roadway systems. Such systems are typically injection molded of relatively rigid material. Such systems are made up from an assortment of short sections, requiring excessive hand labor to assemble. Such systems are typically designed to be set up in only one compact, congested pre-determined configuration. One such system does include a short section of flexible track, assembled on coilspring conductors, made up of many small molded cross sections, which are highly susceptible to breakage. The system comes with such cautions as do not use on carpet surface, do not allow curve to be anything but smooth and including special repair instructions and repair parts. Such systems of which the prior art is typical are characterized by a distinct lack of longitudinal and vertical flexibility and modularity, severely limiting the bending the roadway can be subjected to and thus limiting the track configurations which can be achieved by using these roadways and therefore limiting the total play value of the toy. Typically, the limiting factor is the structure of the roadway itself which cannot be bent or curved beyond a certain minimum limit without causing the electrical conductors to break or pull away from the insulative member to which they are attached. Typically, the prior art total assembly is bulky, difficult to assemble for play and difficult to package and store because of the inflexible construction of the roadway. Such systems manufacturing costs are quite high due to the volume of individual components, the cost of molding many short and small parts, as well as the excessive amount of labor required to assemble the many sub-assemblies.

SUMMARY OF THE PRESENT INVENTION

In contrast, the present invention is a roadway vehicle system of the flexible type which is adaptable to use with all types of vehicles and is particularly suited for use as a toy slot car system. The flexible roadway system utilizes a flat thin highly flexible roadway for supporting the vehicle. The present invention provides a roadway system comprising a length of flat material having a flat mounting surface, having a flat roadbed traction surface and having a pair of recesses extending longitudinally of the material on the flat traction surface thereof.

The system includes a vehicle mounted on one longitudinal surface of the roadway. The material of the roadway is relatively flexible about its lateral axis and relatively rigid about its longitudinal axis. Two thin conductive strips are slidably mounted in each of two recesses. One of the flat metallic strips of each recess extends from one end to a point approximately one half the total length of the roadway recess and the second metallic strip extends from the opposite end to a point overlaying the end of the first strip by several inches, resulting in a slidable electric conductive transfer of power between the first conductive strip and the second conductive strip, each separate strip being freely and independently slidable in its respective recess in the flat upper surface of the roadway.

Motor means are located within the vehicle and contact means are mounted on the vehicle for establishing electrical contact with the conductive strips for transmitting electrical power from the flexible conductive strips to the motor means. Drive means are mounted on the vehicle which are in frictional contact with the roadway, with means provided for transmitting mechanical drive force from the motor means to the drive means and additional means providing for transmitting electrical power from a source of power to the conductive strips.

Dual guide means are mounted on the vehicle in contact, in a sliding manner, with the vertical side walls of the channel recesses of the conductive strips in the roadway for guiding the vehicle longitudinally on the traction surface of the roadway. Additional means are mounted rearward on the vehicle for limiting the side slippage of the drive means on the traction surface of the roadway, as the powered vehicle turns on a curve at high speed, eliminating a need for crash rails.

The present invention provides a vehicle roadway system which is characterized by a degree of flexibility and adjustability not previously achieved for use by powered vehicles. Due to the inherent design limitations in prior art roadway systems, bending of the roadway of such systems has been extremely limited. This is due to the fact that in such prior art systems, the conductors are secured and rigidly held in place in their rigid support means whether the conductors are embedded in or firmly attached to insulative supports. This means that a very limited amount of bending can be sustained without causing the insulative supports and metallic conductors to separate due to the different coefficients of expansion. Separation causes a number of operating problems, including loss of electrical contact and drive power to the vehicle.

The present invention provides a roadway system upon which a vehicle travels, in which essentially unlimited numbers and types of configurations can be obtained by design and selection of the user, including abrupt changes of elevations and inclination and bridges over obstacles. Ease and economy of manufacture results due to the provision of a roadway strip, which utilizes a very simple low cost extruded flat strip preferably of plastic, as the insulating support for the conductors, having flanged recesses for slidingly receiving the metallic conductors to provide power to the vehicle. The sliding reception in flanged channel recesses of the metallic conductors means that the metallic conductors are freely movable in the recesses and, under bending, actually creep in either direction relative to the flat plastic insulating support material, to accommodate the randomly selected roadway configurations.

The invention is also characterized, because of its simplicity of manufacture, with an ease of user assembly and disassembly. The roadway can be erected in many different outdoor locations as well as indoor locations and can be adapted to uneven flat surfaces as well as smooth surfaces. Other practical advantages also flow from the roadway system of the present invention in that the roadway flexibility makes it easier to package and store and ship in smaller cartons.

A very important feature of the present vehicle supporting roadway invention, in addition to being highly flexible, is that it is self-supporting and requires no external supports when set up on either a smooth flat surface such as a floor or an uneven surface such as an outdoor lawn, over a sidewalk, up one or more steps and the like, where the flat flexible strip will generally follow the general profile of the surface upon which it is placed. The ease of relocating the flexible roadway encourages the child to be creative in selecting new locations and configurations of their own design.

The adaptability and flexibility is further illustrated however, by the provision of a recess or open channel formed in both longitudinal side edges of the flat roadway strip for the reception of supports which permit the roadway system to be mounted on supports at randomly selected locations and positions along entire length of roadway, such as a change of grade or elevation to create hills and valleys of different heights.

The present invention is also characterized by means to limit and control drive wheel side skid, at high speed, on a tight curve. Said means will allow a limited amount of realistic skidding, short of going off the roadway.

The vehicles shaped conductors make electrical connection with the thin flat metal conductors located well below the roadway traction surface of the roadway, transmitting the power to the motor and the drive wheels mounted on an axle, receiving drive power from the motor through power transmitting means for gripping the traction surface of the roadway. Additional means provide for transmitting electrical power from a source to the conductive strips.

The plastic from which the flat strip is preferably fabricated is a flex vinyl which has a non-mirgrating plasticizer which combines the desired characteristics of easy extrudability while, at the same time, resulting in a roadway strip which has the desired degree of flexibility about its lateral axis. In addition, polypropylene, polyethylene and styrene have also been found to be suitable as the material from which the basic roadway strip is fabricated.

Due to the flexibility of the present invention with the unique way in which the conductive strips are slidably supported in and mounted by the roadway, long sections and the total assembly can be disassembled and coiled up on a diameter of as small as twelve inches, allowing the entire unit to be stored in a very small, compact container.

DESCRIPTION OF THE DRAWINGS

These and other advantages of the present invention will be better understood by reference to the attached drawings wherein.

DESCRIPTION OF A SPECIFIC EMBODIMENT

Figure 1:
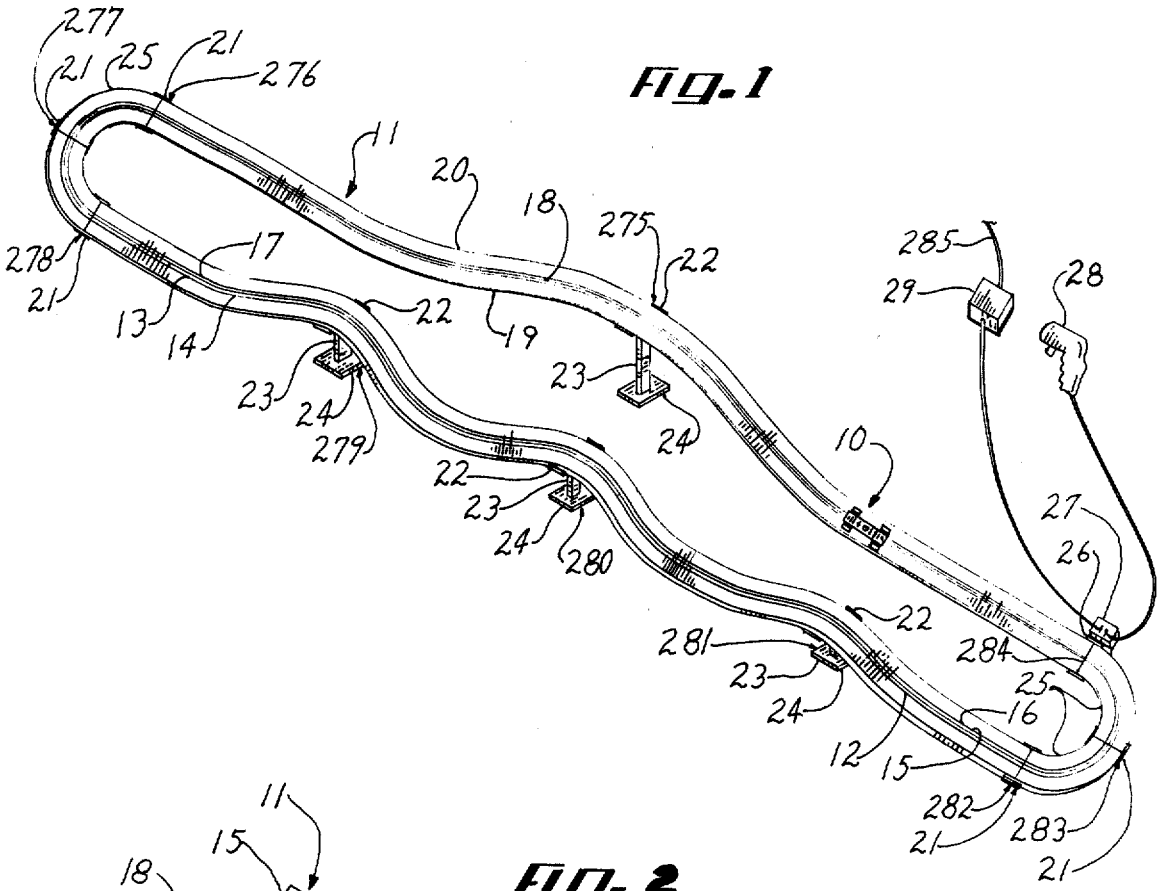
FIG. 1 is a perspective view of a roadway system according to the present invention.

The roadway system of the present invention is shown in FIG. 1 in one of the many configurations in which it can be arranged. As shown therein, the roadway arrangement is generally an elongated closed oblong shape in which the roadway undergoes several changes in elevation. The invention comprises a vehicle 10 mounted on one of the longitudinal flat surfaces of a flat thin length of a non-conductive extruded strip or band 11 of plastic material which defines the roadway. In its presently preferred embodiment, the roadway is approximately one eighth of an inch thick and one and three fourth inches wide. A first flat thin metallic strip 12 is slidably received within the first flanged recess 14 molded into one side of the roadway 11. Metallic strip 12 extends from one end of recess 14 and ends at approximately half way from each end of the length of roadway 11. A second flat thin metallic strip 13 is slidably received within the same first flanged recess 14 from the opposite end and extends in to meet and overlap the end of the first metallic strip 12 by several inches to create a slidable electrical contact junction within recess 14 at a location approximately one half the distance from each end of roadway strip 11. A third flat thin metallic strip 16 is slidably received within the second flanged recess 15 molded into the same flat surface of the roadway strip 11 as is recess 14. Metallic strip 16 extends from one end of recess 15 and ends at approximately half way from each end of the length of roadway 11. A fourth flat thin metallic strip 17 is slidably received within the second flanged recess 15 from the opposite end and extends in to meet and overlap the end of the third metallic strip 16 by several inches to create a slidable electrical contact junction within recess 15 at a location approximately one half the distance from each end of roadway strip 11. Both recesses 14 and 15 extend along the entire length of the extruded roadway strip 11. A channel or open recess 18 extends the length of the roadway strip 11, at a location one half the distance between the recesses 14 and 15. Recess 18 is adapted to glidingly receive an engaging shaft 236, extending downward from the vehicle 10 chassis which will be described in conjunction with FIG. 13. Recesses or channels 19 and 20 extend the full length of each side edge of roadway 11 which open outward to slidingly receive roadway section connector 21, which will be described in conjunction with FIG. 5. In addition recess channels 19,20 are also adapted to receive the roadway support top clamps 22, which will be described in conjunction with FIG. 10. The top clamp 22 is mounted on support extension arm 23, which will be described in conjunction with FIG. 12. The support extension arms are mounted on support base 24, which will be described in conjunction with FIG. 11. Roadway turn sections 25 are injection molded and will be described in conjunction with FIG. 7.

Turn sections are included in the configuration to change the roadway direction by 90 degrees, for each one used. FIG. 1 configuration utilizes two turn sections 25 at each end to form the closed, oblong roadway layout. Shown near one end is a power adapter connector 26, connected into the power junction box 27. Adapter connector 26 will be described in conjunction with FIG. 6. The power junction box 27 will be described in conjunction with FIG. 9. A speed controller 28 and a D-C transformer 29 are shown plugged into power junction box 27 and in conjunction with adapter 26 will provide controlled electrical power to the roadway conductor bands.

The conductive metal bands or strips 12 and 13 are freely slidable in flanged recess 14 and the conductive metal bands or strips 16 and 17 are freely slidable in recess 15, of the plastic vehicle roadway, to permit the bands to creep or slide in either direction to conform with which ever configuration is selected for the roadway system layout.

As is shown by the FIG. 1 illustration, the roadway according to the present invention, can be configured in an essentially limitless number of configurations, including 360 degree up and over loops; not shown. A long length, on the order of 20 feet, can be started at floor level, ramped up and over an obstacle such as a coffee table or chair seat and then ramped down to lay flat on the floor. This is because the roadway strip and metallic bands curve and readjust themselves by curving to basically accommodate the object over which it is positioned.

The flexibility of the roadway strip makes it possible to provide for significant changes in elevation for interesting floor play, by use of special supports having an assortment of different length extension arms, as shown in FIG. 1, where different supports form different height hills with valleys between.

As seen in FIG. 2, 4, 7, and 15 the flat metal band conductors 12, 13 and 16, 17 are received in recesses 14 and 15 which are equally spaced on each side of center positioned recess 18. A wide expanse of plastic provided outward of recesses 14, 15 is used, as a traction surface which is engaged by the power drive wheels on the vehicle, which is run on the flat roadway, upper surface.

As can be seen from the drawings, the roadway band of the present invention provides a number of functions, including mounting the metallic strip conductors for providing electric power to the vehicle, providing load bearing support, namely, the upper longitudinal flat horizontal surface for rolling support of the vehicle to be run on the surface and, for the movement of the vehicle forward or backward on the roadway strips and turn sections. The roadway also provides the means to guide the vehicle, which includes twin guide shaft extending downward into recess channels 14 and 15 for gliding along between the smooth side walls of the recesses, following the roadway configuration, however arranged. The roadway also provides the means to retain the forward direction of the rear drive means as vehicle speeds around a sharp turn, as the center recess 18 receives the downward extending guide shaft from the vehicle restrictive skid unit, pivotally mounted on rear portion of vehicle chassis. The vehicle is allowed to side slip, producing a realistic skid on curve but is stopped at a point short of fish-tailing itself off the raodway.

In the presently preferred embodiment, the roadway strip is of a plastic sufficiently flexible longitudinally of the material, so that it can be curved on a six inch radius and into inclines of different heights and sufficiently rigid transversably of the material to support the vehicle. In the present preferred embodiment, the roadway strip or band is a continuous length of an extruded plastic, such as flex vinyl, of a pre-determined measurement and has slip connectors which attach to the free ends of the long lengths and to turn sections to complete the mechanical and electrical connecting of the closed, oblong loop.

In extruding the plastic roadway strip, the dimensions of the flanged recesses 14 and 15 are arranged such that sufficient space is provided for receiving the thickness of the metallic bands 12,13 and 16, 17 themselves, including the overlapping freely moving end portions.

Figure 2:
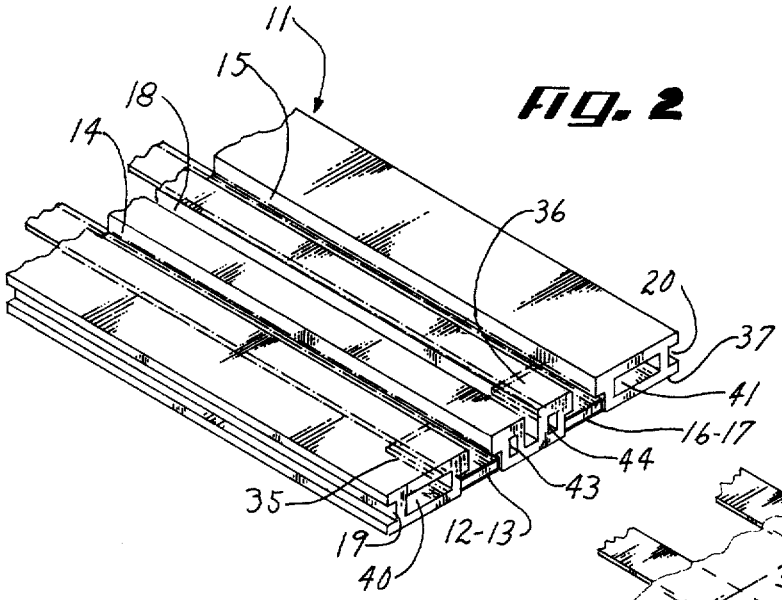
FIG. 2 is a fragmentary view in perspective of a typical upper surface end portion of roadway illustrating channeled metal band ends formed down and tucked under according to the present invention.

A view of a typical end portion of an extruded roadway strip 11 is shown in FIG. 2, and is representative of either end of a roadway strip section, having flat metallic bands slidingly positioned in recesses, which are representative of either 12 or 13 in recess 14 and either 16 or 17 in recess 15. The thin metallic bands are free to slide and move in either direction in their respective recesses, except at the extreme ends. Said ends are held firm and secure by being formed downward and under, to lay flat against the lower under surface 37 of the roadway strip at positions 35, 36.

Figure 3:
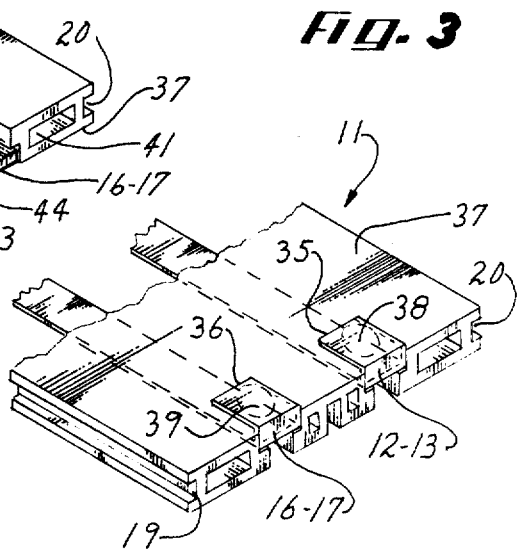
FIG. 3 is a fragmentary view in perspective of a typical underside view of ends of all roadway sections illustrating fixed conductor band ends according to the present invention.

A view of the typical under side of an end portion of extruded roadway strip 11, as shown in FIG. 3, exposing the smooth flat surface 37, (it is surface 37 on which the roadway strip normally rests when in use) showing the metallic band ends formed over to lay flat on surface 37 where the band ends are held secure by a small spot of adhesive at 38, 39. The short portions of the band ends, on the order of one half to one inch, act as the contact points for transmitting electrical power to the roadway metal conductors from a source, through contact with the roadway section connector, which will be described in conjunction with FIG. 5.

The channels 19, 20 extending in both longitudinal side edges of the flat roadway, extend full length of the roadway 11. The open recess channels 19 and 20 are utilized for attachment of top clamp part 22 of the roadway strip riser support assemblies, which will be described in conjunction with FIG. 10, 11 and 12. Recess 19 and 20 provide the means whereby the supports may be attached at any selected spot along the length of roadway, for supporting the roadway strip at different heights, creating hills and valleys in the flexible material. Channel recesses 19, 20 are also the means whereby the different roadway sections are firmly joined end to end. The recesses 19, 20 at ends of roadway sections are slidingly inserted on runners provided on section connector 21, which will be described in conjunction with FIG. 5 and FIG. 6.

Two larger lightening passages 40, 41 as well as two smaller lightening passages 43, 44 as shown in FIG. 2 extend longitudinally, interiorly, of the length of all roadway sections. The lightening passages provide a means to achieve a uniform wall thickness for transverse dimensional accuracy, as seen in a cross section view of end of roadway in FIG. 2. An extrusion having the uniform wall thickness, saves material and allows the extruder machine to produce at a faster rate, resulting in a roadway strip free of hot sink depressions, at a reduced cost per length.

Figure 4:
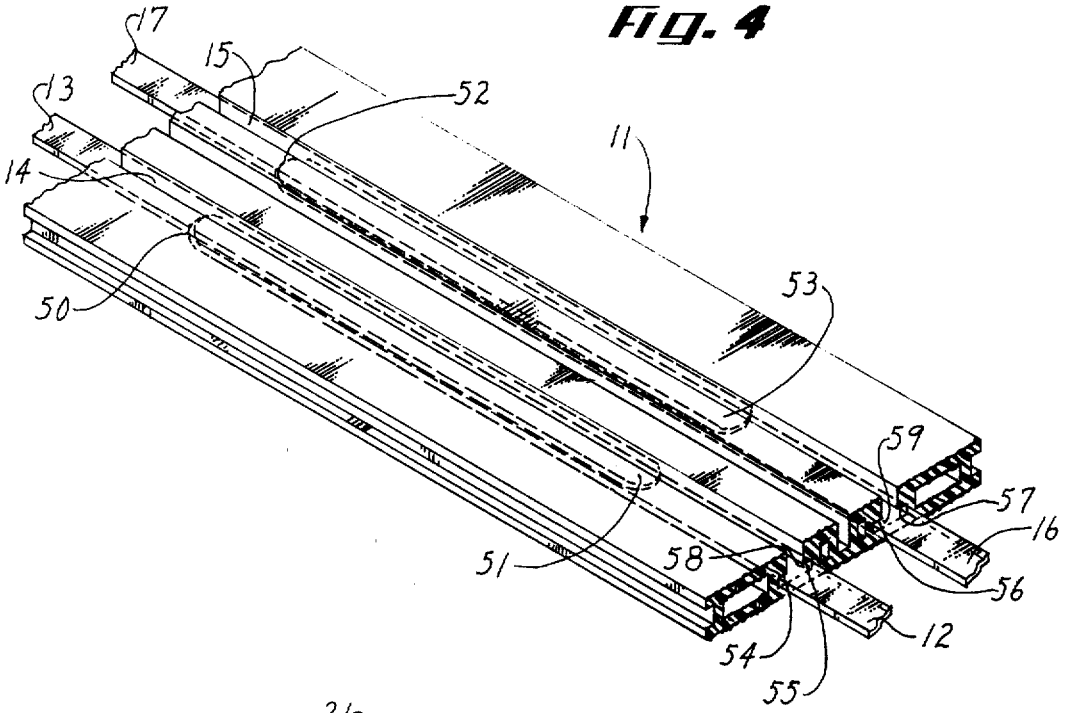
FIG. 4 is a fragmentary view in perspective of a typical electrical sliding contact of the overlapping metal conductors, centrally located in flanged recess channels in roadway strip according to the present invention.

As shown in FIG. 4, the ends of the freely slidable conductive strips 12, 16 underlie the interior most ends of the freely slidable conductive strips 13 and 17. As also shown in FIG. 4, the freely slidable conductive strips 13, 17 overlie the freely slidable ends of conductive strips 12 and 16 by a significant amount, on the order to the two to four inches as in FIG. 4. The end of conductor 12 is shown at 50. The end of conductor 13 is shown at 51. The end of conductor 16 is shown at 52. The end of conductor 17 is shown at 53. The fragmentary portion of roadway section 11, as shown in FIG. 4, is representing that portion of a typical roadway approximately one half the distance from each end as the preferred location where the freely slidable metallic band end portions meet and overlap, to create a slidable electrical contact between the pairs of freely slidable conductors slidingly placed in recesses 14 and 15. As shown in FIG. 4 the flanges 54, 55, 56, and 57 of the recesses 14 and 15, overlie the edges of the metallic conductors 12, 13 and 16, 17 by a significant amount, allowing freely slidable movement of said conductors within the boundary of the flanged area 58 and 59.

The flanged area 58, 59 is sufficiently wide and deep enough to allow the metallic strips unrestricted free movement, the length of the roadway material, to slide and reposition themselves, as required to conform with the highly flexible roadway strip 11 configuration.

Figure 5:
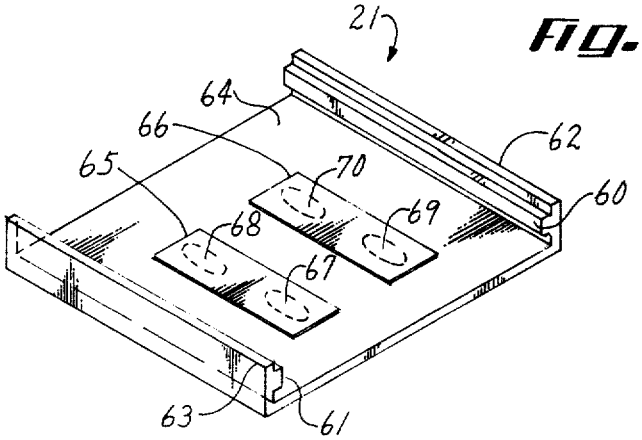
FIG. 5 is a perspective view of a section connector used to join two roadway sections illustrating power transmitting plates according to the present invention.

The connecting means or roadway section connector 21, as shown in FIG. 5 is a molded unit, preferably of the same material as that used to form the roadway strips. The protruding side runners 60, 61, projecting inwardly from inner surface of side walls 62 and 63, are dimensioned such that they will easily slip endwise inside recesses 19 and 20, extending longitudinally in each side edge of roadway sections. The width dimension across upper surface 64, of the base portion of the connector 21, between walls 62, 63, is slightly more than the width dimension of the roadway strips, to allow the roadway end portions a slip clearance between the conductor side walls 62, 63 of the connector 21.

As shown in FIG. 5, two flat metal conductive plates 65, 66 are positioned on base upper surface 64, for transmitting electrical power from one roadway section to another roadway section. conductive plates 65 and 66 are held secure to upper surface 64 by small spots of adhesive at positions 67, 68, 69 and 70. The plates 65 and 66 are positioned such that when the ends of two roadways are slidingly placed into open ends of connector 21 where they meet end to end, at a location one half the distance from each open end of connector, at which position, the underlying contact ends of the band conductors of the roadway will overlay the ends of plates 65, 66, where each plate will transfer electric current from one metallic conductor of one roadway section to a corresponding metallic conductor of a second roadway section. When the roadway sections ends are slidingly moved into the connector 21, the connector runners are engaged into the roadway edge channels 19 and 20, as the roadway underlying surface 37 of roadway sections slide over surface 64 of connector base. The underlying contact ends of roadway conductors ramp up onto the connector plates 65 and 66, requiring a slight increase in pressure to assemble, creating a desired firm assembly and achieving a positive mechanical and electrical junction. Connector 21 is utilized to make connection at all joining sections of roadway system, except at the final connection where the electrical power is introduced from a source into the metallic conductor loop system of the roadway loop.

Figure 6:
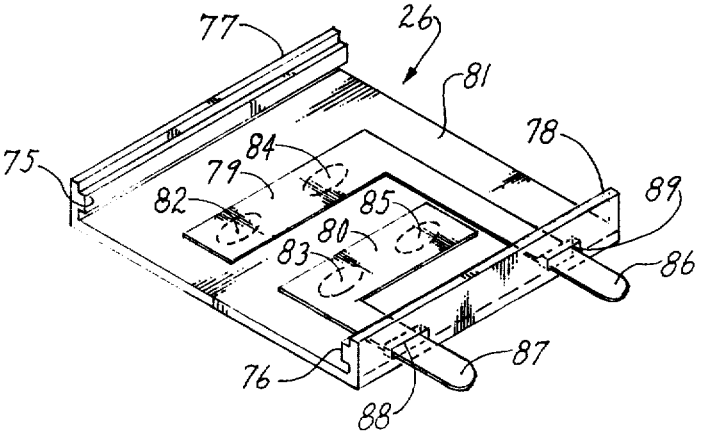
FIG. 6 is a perspective view of a roadway power adapter connector illustrating power transmitting plates side extending conductors according to the present invention.

A roadway power adapter connector 26, as shown in FIG. 6, is used for connecting the roadway sections free ends at one location, to transmit electrical power from power connecting junction box 27, to the roadway metallic band conductors. The basic plastic portion of connector 26, is of a design and dimensions as is connector 21, except for the contact conductor plates. The inwardly protruding sidewall runners 75, 76 are positioned on inner surface of vertical walls 77 and 78, for sliding endwise into side edge recess 19, 20 of roadway sections. Contact plates 79 and 80 are positioned on base upper surface 81, for transmitting electric power from power connecting junction box 27, to the roadway metallic conductors. The conductive plates 79, 80 are held secure to surface 81 by small spots of adhesive 82, 83, 84 and 85. The contact plates are positioned such that when the free ends of two different roadway sections are slidingly placed into the open ends of connector 26, to meet end to end at a location one half the distance from each open end of the connector, the underlying contact ends of the metallic conductors of roadway sections will overlay the ends of plates 79 and 80. Each plate will transmit electrical power from power connecting junction box 27, which will be described in conjunction with FIG. 9, to a first metallic conductor of one roadway section and to a corresponding conductor of a second roadway section. Conductor plates 79 and 80 have extension arms 86, 87 respectively, extending laterally and which pass through openings 88 and 89 in vertical wall 78 and terminate about one inch outside the outer wall surface of sidewall 78. The ends 86, 87 are round shaped for ease of sliding into power junction box 27.

Figure 7:
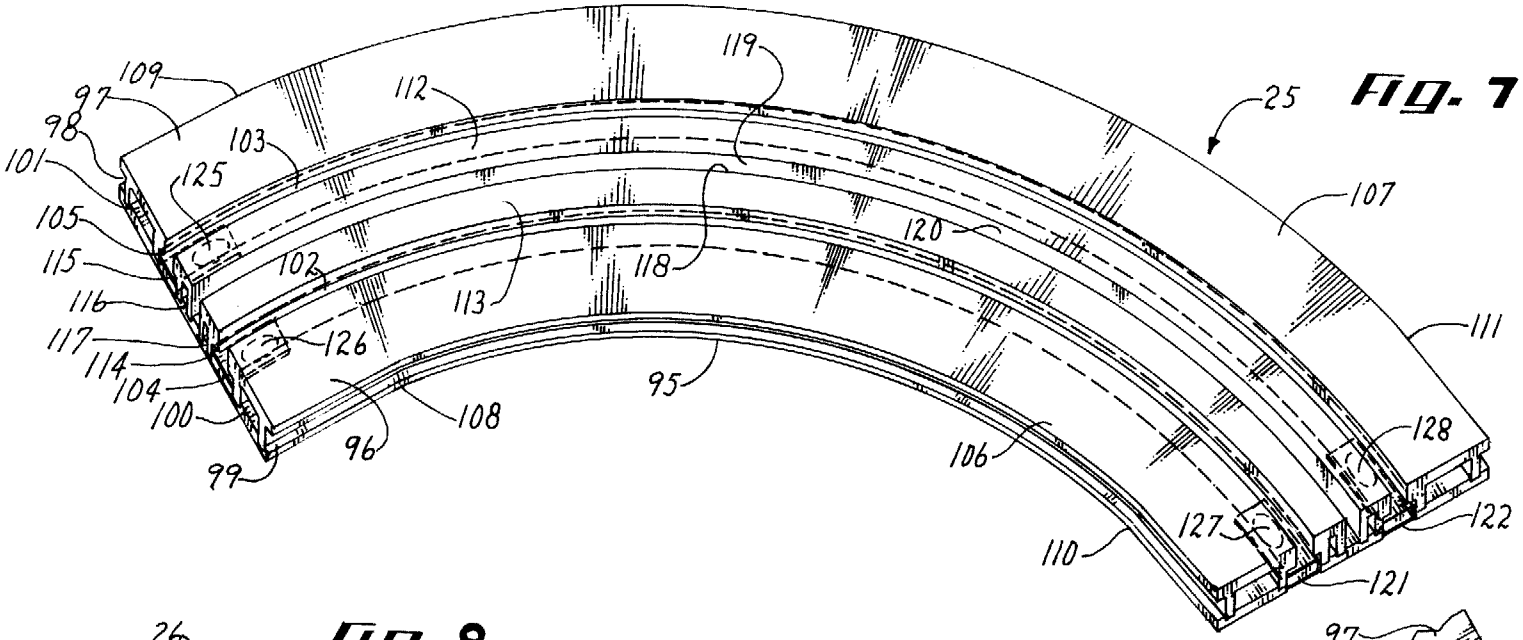
FIG. 7 is a perspective view of a injection molded roadway turn section according to the present invention.

A curved roadway section 25 is shown in FIG. 7, which is used at ends of roadway sections 11, to change the direction of the configuration. Section 25 is preferably fabricated from the same type material as the section 11, by the injection molding process, which will be described in conjunction with FIG. 8. The cross section web configuration, as seen at either end of FIG. 7 is identical in shape and dimensions as is the extruded cross section of section 11. The base portion 95, has grooves molded into its upper surface, to locate and position the following mating parts that make up the curved section 25. Parts 96, 97 form edge recesses 98, 99 in conjunction with the outer upper surface of base 95. Parts 96, 97 also form the larger oblong passages 100, 101 in conjunction with upper surface of base 95. Said passages extend interiorly the length of section 25. Parts 96, 97 also form one flange of the conductor channel recesses 102, 103 at locations 104, 105 and the upper surface of parts 96, 97 provide the surfaces 106, 107 on which the vehicle drive wheels grip, when in powered motion. As illustrated in FIG. 7, the curved sides of section 25 each has a straight portion extending one inch at 108, 109, 110 and 111 to provide a mating edge which is straight for a sliding connection into the side wall straight runners of roadway section connector 21, described in conjunction with FIG. 5. Parts 112, 113 of section 25, form the second flange 114, 115 of the conductor channel recesses 102, 103 and also form the two smaller passages 116, 117 in conjunction with the upper surface of base 95. Said passages 116, 117 extend interiorly the length of section 25. Parts 112, 113 also provide the vertical sidewalls 118, 119 of the center positioned longitudinal recess 120. Section 25 metallic conductor bands 121, 122 are die-stamped, on a curve as required to fit in the curved flanged channels 102, 103.

Assembly of section 25 starts with placing the metal conductors 121, 122 in their locations on the upper surface of base 95 and parts 96, 97 and 112, 113 are placed in their respective positions, forming the flanged recesses in which the conductors 121, 122 are confined. The extending ends of bands 121, 122 are formed down and back under, to lay flat against the smooth flat under surface of base 95 where they are held secure by a small spot of adhesive at locations 124, 125, 126 and 127. Said short portions of band ends act as contact points for transmitting electrical power to the metallic conductors of roadway section 25, from another roadway section, through conductor plates of a roadway section connector. Conductors 121, 122 are preferably fabricated from the same thin metal as used to fabricate the conductor bands of section 11.

Figure 8:
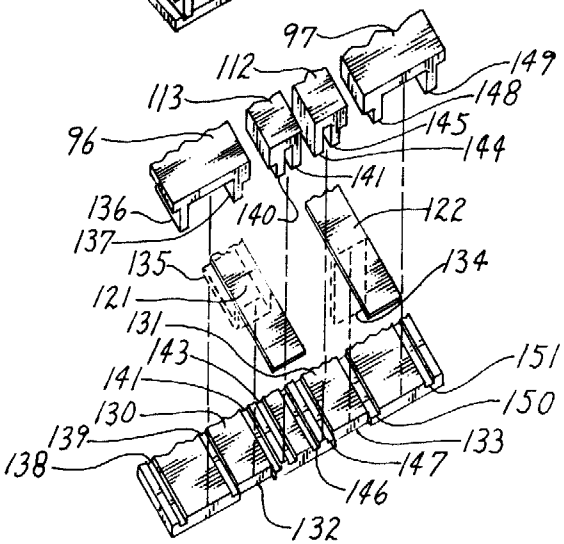
FIG. 8 is a fragmentary exploded perspective view of a typical injection molded roadway section to illustrate the separate parts, end view configurations and to describe the assembly sequence according to the present invention.

FIG. 8, is a view of an end of the curved roadway section 25, described in conjunction with FIG. 7. The drawing is exploded and fragmentary to illustrate the configuration of the parts profiles and to explain the important points of the different parts and sequence of assembly. Base 95 has shallow locative grooves for locating mating parts which are sealed in position with a solvent or other known attachment means.

The metallic conductors 121, 122 are placed flat on base 95 upper surface at 130, 131 where the ends extend beyond ends of base 95, on the order of three fourths of one inch, to be formed downward in cutout area 132, 133 then formed back under, to lay flat on the smooth under surface of base 95 as indicated by dotted lines 134 and 135, where the band ends are held secure by adhesive spots. First curved part 96 flanges 136, 137 are placed in base grooves 138, 139 and fixed in place. Second curved part 113 flanges 140, 141 are placed in base grooves 142, 143 and fixed in place. Third curved part 112 flanges 144, 145 are placed in base grooves 146, 147 and fixed in place. Fourth curved part 97 flanges 148, 149 are placed in base grooves 150, 151 and fixed in place.

Figure 9:
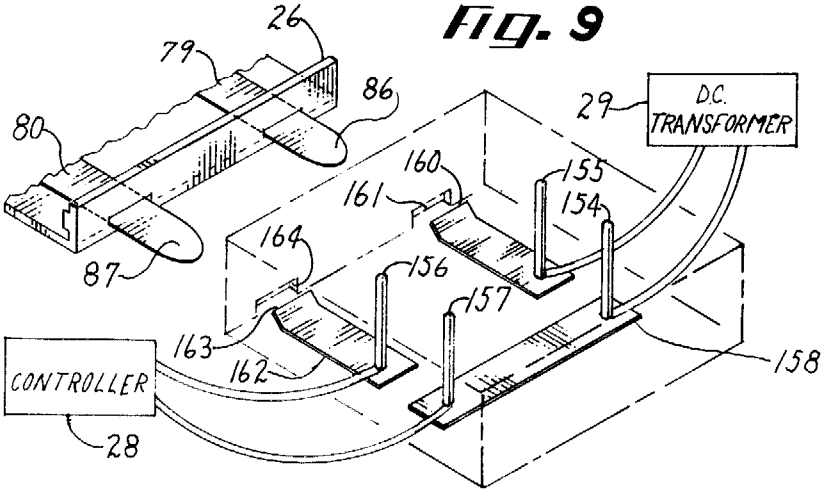
FIG. 9 is a perspective view of an electrical connector junction box illustrating the electrical connections through the connecting unit to the fragmentary perspective view of power adapter connector extending side conductors according to the present invention.
Figures 14, 15:
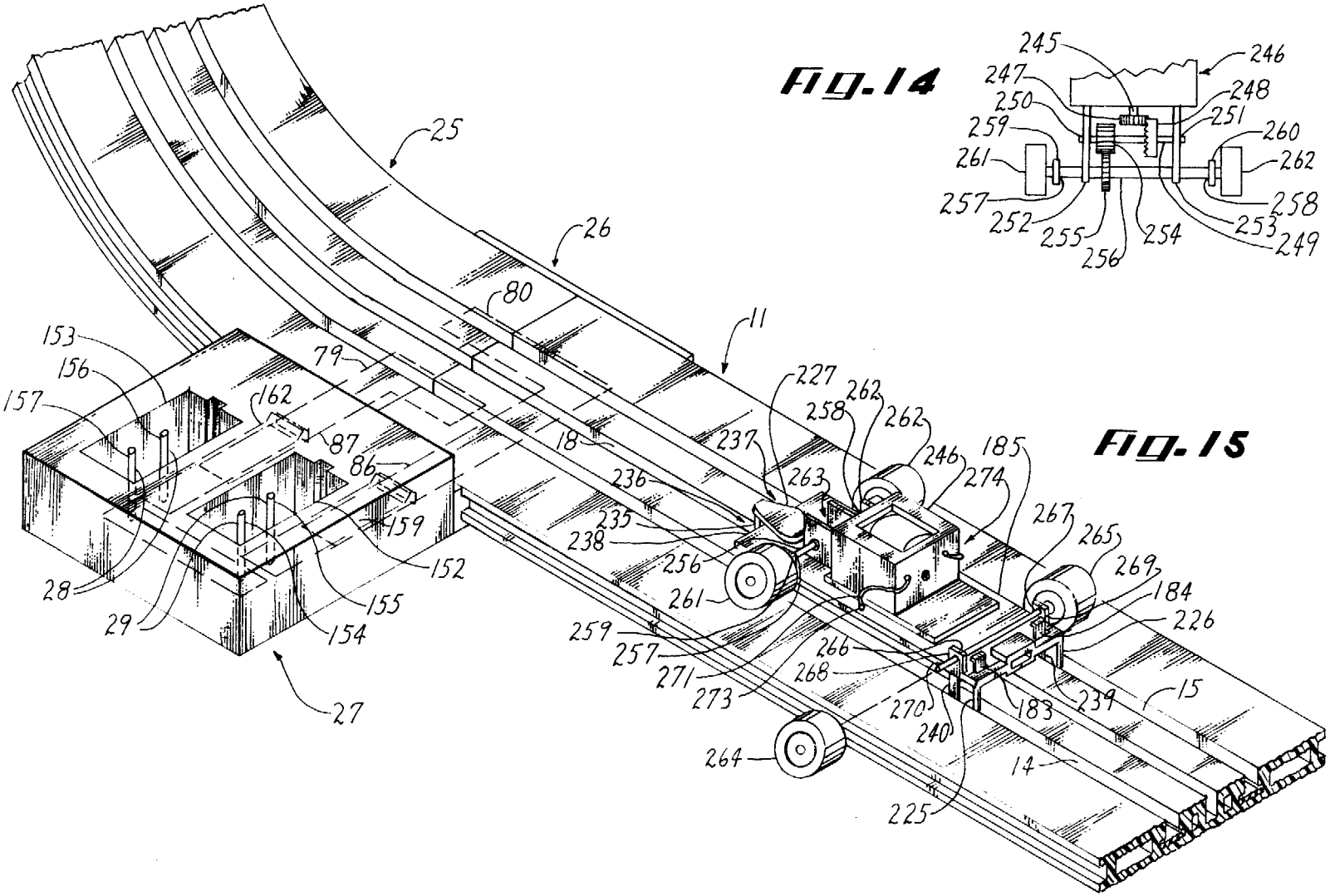
FIG. 14 is a top plan view of the power transmitting means between motor means and drive wheel axle as utilized by the present invention.
FIG. 15 is a fragmentary perspective view of joined roadway section ends by adapter connector which is connected to electrical connector junction box including view of vehicle mounted on roadway, with body shell omitted to expose electrical pick up conductors and twin guide means according to the present invention.

As seen in FIG. 9, power connecting junction box 27 has two socket or receptacle pairs of pins disposed therein. The sockets or receptacles 152, 153 are shown in FIG. 15 and will be described in conjunction with FIG. 15. Conductive pins 154, 155 are disposed in receptacle area 152 and adapted to receive a plug from a power source 29, FIG. 1, such as a step down D-C transformer, which is in turn, connected to a conventional source of power such as a 110 V power outlet. Conductive pins 156, 157 are disposed in receptacle area 153 and are adapted to receive a plug from a controller 28, FIG. 1, such as the type of hand-operated potentiometer used in controlling slot cars of prior art. Controller 28 determines the amount of power that is supplied to conductors in the roadway, and thus, controls the speed and pulling power of the vehicle.

By means of a plug-ended connector, a D-C transformer 29 is connected to pins 154, 155 in receptacle area 152. A slide wire controller 28, is connected by means of a plug-ended connector to pins 156, 157 in receptacle area 153. Pin 154 in receptacle area 152 and pin 157 in receptacle area 153 are inter-connected by conductive strip 158. The second pin 155 in receptacle area 152 is electrically connected to a conductive strip 159, which is turned upward at tip 160, to create a blade conductor with means to receive side arm extension of roadway adapter connector plate 79, in through opening 161 to rest firmly against under side of spring blade conductor 159. Second pin 156 in receptacle area 153 is electrically connected to a conductive strip 162 which is turned upward at tip 163, to create a blade conductor with means to receive side arm extension of roadway adapter connector plate 80, in through opening 164 to rest firmly against under side of spring blade conductor 162.

Figure 10:
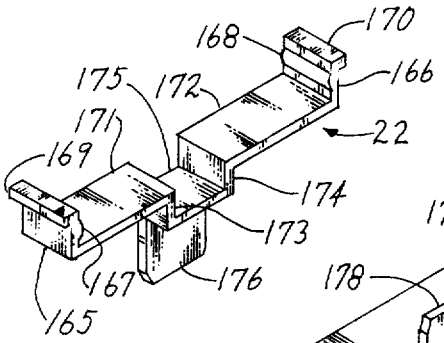
FIG. 10 is a perspective view of a typical roadway support strip clamp according to the present invention.
Figure 11:
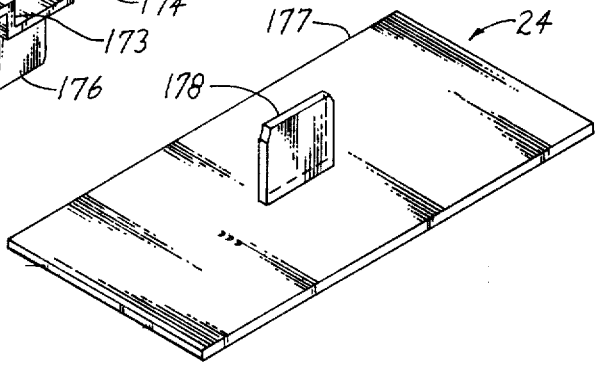
FIG. 11 is a perspective view of a typical roadway support base plate according to the present invention.
Figure 12:
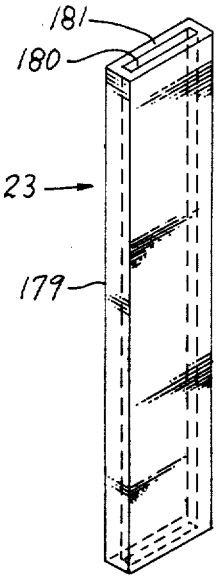
FIG. 12 is a perspective view of a typical roadway support extension arm according to the present invention.

As shown in FIG. 1, the typical elevating supports for raising the roadway system, consists of three separate and different parts. As shown in FIG. 10, the upper clamp on portion 22 consists of two vertical upward extending side flanges 165, 166 having half-round runners 167, 168 extending horizontally across the inner face of said flanges, and having short pressure tabs 169, 170 extending outward from upper outer surface of flange 165, 166. Said flanges are vertical extensions of out-streached horizontal flat arms 171, 172, which have short vertical portion 173, 174 extending downwardly to terminate on each side of a central plate 175 and a mounting blade 176 extending downwardly, on the order of one half of one inch. Said blade has the lower two corners removed. FIG. 11 illustrates base 24, consisting of a flat oblong plate 177 with a vertical upward projecting mounting blade 178, on the order of one half of one inch. Said blade has the upper two corners removed. FIG. 12 is the support riser 23 consisting of a length of oblong extrusion 179 with an oblong open passage 180, creating a balanced wall thickness 181 on all sides of the extrusion.

The clamping portion 22 is fitted upward onto the bottom of roadway sections so that the lower surface of roadway lays on flat horizontal arms 171, 172. At the same time the half-round runners 167, 168 will snap up and lodge in the side channels of roadway sections. The mounting blade 176 is slidingly positioned at one end of extension riser 23 in oblong passage 180. Riser 23 is slidingly positioned on blade 178 of base 24. An assortment of different length risers 23 may be used, from one inch to fourteen inches or more. The elevating supports may be located at any longitudinal position around the configuration of the roadway by utilizing the roadway edge recesses. The clamping unit 22 is easily removed from a roadway strip by applying a slight downward pressure on tabs 169, 170 which will cause the flat resilient arms 171, 172 to flex slightly, allowing the half-round runners 167, 168 to move outward and downward from engagement with roadway side recess channels.

Figure 13:
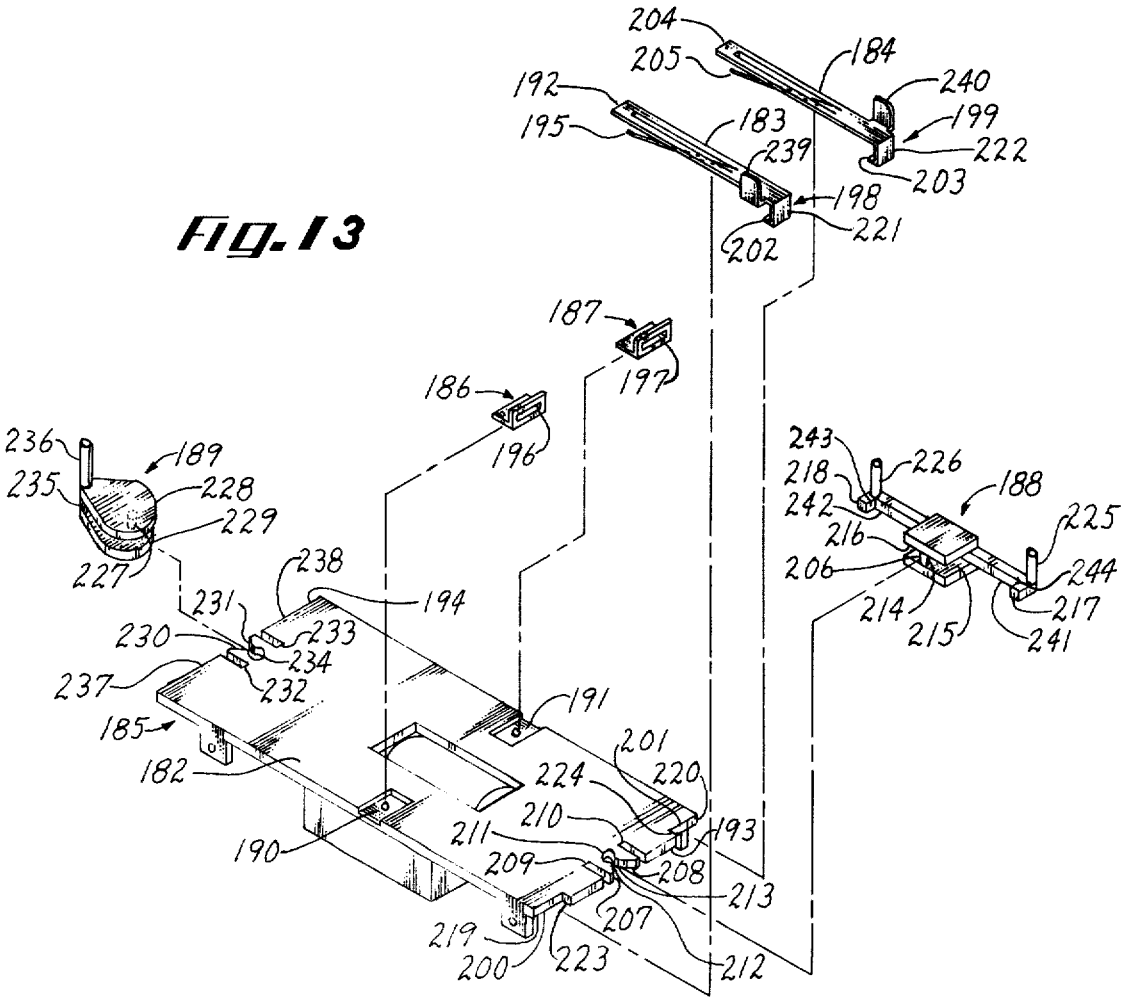
FIG. 13 is is an exploded perspective view of the underside of vehicle chassis plate, the conductors, the conductor contact brackets, twin guide assembly and the restrictive skid unit to illustrate locating assembly sequence according to the present invention.

FIG. 13 is an exploded view of the under-side surface 182 of vehicle chassis 185. The vehicle portion is shown in an upside-down position, with the important parts exploded from their assembled locations for clear illustration to better describe the parts and assembly sequence. The vehicle mounted electrical pick-up conductors 183, 184 are die-stamped and fabricated from a thin electrical conductive material, such as thin brass sheet. The twin guide pin structure 188 and the restrictive skid unit 189, are injection molded from a non-conductive plastic material. The same plastic material is preferred for the molding of the vehicle chassis plate 185.

Brackets 186, 187 are positioned in depressions 190, 191 wherein they are secured by conductive rivets, not shown. Said rivets are in secure contact with the conductive wires to the vehicle motor as shown in FIG. 15. Pick-up conductors 183, 184 are placed on the smooth under surface 182 of chassis 185 with the smooth tips of thin leaf springs 195 and 205 in contact with surface 182. The flat ends 192 and 204 of conductors 183, 184 are moved from forward end 193 of chassis 185, in the direction of rear end 195 of the chassis, to a position near brackets 186, 187, at which time the conductors 183, 184 are gently pressed downward, depressing the resilient leaf springs 195 and 205 against the smooth slidable surface 182 and at the same time, guiding ends 192 and 204 into slots 196, 197 of brackets 186, 187, also at the same time, guiding the hook-like end 198, 199 of pick-up conductors downward to hook over cutout area 200, 201 of 193 end of chassis, where end portions 202, 203 will overlay on the upper surface edge of chassis. Conductor ends having entered slots of the brackets to act as hinge means as the conductors move up or down against resilient leaf spring and at the same time, having a pre-determined measure of movement, controlled by forward hook-end restriction on chassis upper and lower surfaces.

Pick-up conductors are retained in cutouts 200, 201 by the twin guide pin structure 188. The vertically inclined locking shaft 206 of 188, is pressed between guide ramps 207, 208 which will spread, due to relief slots 209, 210, when shaft 206 moves into retainer cutout 211 where corners 212, 213 will maintain a constant pressure against inside radius 214 of shaft 206, forcing unit 188 into constant firm contact with leading edge 193 of chassis 185. The inside surfaces of upper and lower alignment plates 215, 216 are fitted over upper and lower surfaces of chassis 185 as lock-shaft 206 is pressed into retainer 211, thus giving unit 188 lateral stability and providing end portions 217, 218 with true end alignment and firm contact against the forward outer corners of chassis 185 at 219, 220, creating a four sided vertical slot in which vertical portion 221, 222 of hook-like end 198, 199 of conductors 183, 184 will freely move up and down as required, while restricted by 241, 242 from moving forward, thus keeping 192 and 204 ends functionally engaged in slots 196, 197 of brackets 186, 187. Excessive side movement of conductors are restricted by side walls 243, 244 of 188 and by side walls 223, 224 of unit 185 which form the vertical slot in which vertical portion 221, 222 of conductors 183, 184 move vertically. Conductor contact elements 239, 240 extend into roadway conductor recesses where they contact the conductive bands of roadway in a resilient firm sliding contact for transmitting electrical power to vehicle motor, as seen in view of vehicle in FIG. 15 239, 240. The vehicle guide pin elements 225, 226 extend vertically from horizontal arm ends of unit 188. Said guide pins extend into roadway conductor channel recesses to glide along either side wall, to guide the moving vehicle as seen in view of vehicle in FIG. 15, 225, 226.

The restrictive skid unit consists of a shaft 227 which is located between alignment plates 228, 229, and is a freely turning mounting means which is pressed in between ramps 230, 231 which will spread, due to relief slots 232, 233, allowing shaft 227 access into retainer cutout 234. The portion 235, not shown, is a spacer extension of alignment plates directly in line with the extending anti-skid pin 236. The spacer supports that small portion of the alignment plates and acts as a stop against rear edge 194 of chassis at locations 237, 238. Pin 236 extends downward from vehicle, into roadway center longitudinal recess 18 where it glides along either recess side wall. When the vehicle turns a sharp curve the rear wheels skid sideways causing the restrictive skid unit to follow the vehicle at an ever increasing angle until the angle causes spacer 235 to contact location 237 or 238 at chasses edge 194, at which position skid pin 236 will slide hard against the wall of recess 18 and restrict the vehicle wheel side skid at that angle as the vehicle continues around the curve in a controlled skid.

The drive gear assembly, as shown in FIG. 14, consists of a drive shaft 245 extending rearward from motor 246, shown partially. A spur gear 247 is rigidly secured on one end of drive shaft 245. A crown gear 248 is rigidly secured to a horizontal shaft 249, in meshing engagement with gear 247. Shaft 249 is freely rotatable on each end in bearings 250, 251 fixedly mounted in gear assembly side walls 252, 253 extending upward from chassis 185. Spur gear 254 is rigidly secured to shaft 249. A spur gear 255, rigidly secured on axle shaft 256, is in meshed engagement with spur gear 254. Axle shaft 256 is mounted in free turning bearings 257, 258 fixed in chassis brackets 259, 260. Drive wheels 261, 262 are rigidly mounted on ends of drive axle shaft 256. The vehicle rotating power is transmitted through a gear-train to rotate axle shaft 256 which freely rotates in bearings 257, 258 transferring power to vehicle drive wheels for gripping roadway upper surface.

A view of a drive vehicle 10, of the present invention is shown in FIG. 15. The vehicle is shown with an outer shell or overbody omitted, to expose several important sub-assemblies, including electrical conductors 183 and 184, described in conjunction with FIG. 13, which are in their assembled location on the forward under portion of chassis 185. A drive motor 246 is located generally in the center of the vehicle. A drive shaft extending rearward to engage a gear assembly, shown more clearly in FIG. 14, is located rearwardly on the vehicle chassis at location 263. Basic support for the vehicle, on the flat horizontal roadway, is provided by two axles, each having two wheels rigidly fixed to axle ends. One axle shaft 256 is mounted at a rear portion of the vehicle chassis through bearings 257, 258, fixed in upward extending brackets 259, 260 with drive wheels 261, 262 secured at each end of axle 256 and connected through a gear train to the motor.

A second axle shaft 270 is mounted at a front portion of the vehicle chassis and is free turning in bearings 266, 267, fixed in upward extending brackets 268, 269 with front wheels 264, 265 secured at each end of axle 270.

The vehicle electrical pick-up conductors 183, 184 are shown at or near the front of the vehicle; for details see FIG. 13. Each of conductor 183, 184 has a blade like contact portion 239, 240 extending downward into recesses 14 and 15 of the roadway, where the ends of contact blades make effective sliding contact with the conductive flexible bands for transmitting electrical current from the recessed roadway conductors to the motor.

Electrical energy, supplied from a power source, is transmitted through the roadway conductive bands to the blade contacts 239, 240 of conductors 183, 184 to conductive hinge brackets 186, 187, through bracket mounting rivets 273, 274 and through attached conductive lead wires 271, 272 which are conductively attached to motor 246.

When drive energy is supplied to motor 246, drive shaft 245 rotates. The drive shaft is engaged with drive wheels 261, 262 mounted on axle 256. When power is transmitted by drive shaft 245 through gear assembly detailed in FIG. 14 at location 263, the pair of drive wheels 261, 262 rotate about their gear driven axle under power from drive motor 246, thereby propelling vehicle 10 forward by gripping upper roadway traction surface.

In the preferred embodiment, the wheels are made of non-slip rubber or rubber like material of a wide configuration providing a large contact surface for enhancing the grip on the roadway traction surface. It is also preferred, the wheel tread width be at least two times as wide as the width of roadway recesses 14 and 15, to provide a good gripping surface, even if a portion of the wheel tread skids slightly side-wise to overlap the open top of roadway recesses 14 and 15 on curves.

The twin guide pin assembly is shown at the extreme front end of vehicle chassis 185 in FIG. 15 and detailed in conjunction with FIG. 13. The guide pins 225, 226 are round shafts having a diameter dimension, on the order of one half the width of roadway recesses 14 and 15. The guide pins protrude downwardly into channel recesses 14, 15 where the shaft ends are designed to be slightly above the conductor bands, as the vehicle is propelled along the flat roadway. The pins glide smoothly along either side wall of recess channels 14, 15, effectively guiding the vehicle.

The restrictive skid unit is shown pivotally mounted at the rear of vehicle in FIG. 15 and described in conjunction with FIG. 13. Pin 236 is a round shaft with a diameter dimension on the order of one half the width of roadway recess 18. The anti-skid pin 236 protruding downwardly into central located recess channel 18 where the shaft end is designed to be slightly above the lower surface of channel 18. As the vehicle is propelled along the straight roadway sections, the pin trails the vehicle in a non-restrictive glide along either side wall of recess 18. As the vehicle is propelled around a curve at a speed great enough to cause the drive wheels to skid to the outside curve direction, the angle of the restrictive skid unit will increase as pin 236 skids along the wall of recess 18 while the rear portion of the vehicle chassis swings outward causing spacer 235 of anti-skid to lay against the chassis rear edge 194, at either location 237 or 238, as seen in FIG. 13, which will stop the wheel skid progression and permit the vehicle to continue forward travel. Pin 236 will slide along the channel wall as the vehicle is propelled around a curve at a high rate of speed, allowing the vehicle to develop a realistic rear wheel skid, and restricting the angle of the skid at a point short of the vehicle disconnecting itself from the roadway surface. When the vehicle starts a rear wheel skid, the pivot shaft 227 which is free to rotate within cutout 234, as in FIG. 13, permits pin 236, extending into recess 18, to trail the vehicle at an angle until the spacer comes into contact with the rear edge of the chassis at which point the restrictive pin 236 will resist any further side-slide as the vehicle continues around the curve, side-sliding safely.

A drive vehicle is shown in FIG. 15 in operable engagement with a fragmentary end section of a flexable roadway strip 11. The end of roadway section 11 is telescopically positioned one half the way into power adapter connector 26, so as to slidingly engage in a secure electrical contact between roadway conductor end contact points 35, 36, FIG. 3, and the conductive plates 79, 80 of the adapter connector 26. A portion of a roadway curve section 25 is shown with its free end telescopically assembled into the other end of the electrical distribution adapter connector 26, to slidingly engage the conductor end contact points, on the underside surface of curved section end, and the conductive plates 79, 80 of the power adapter connector 26, which provides electrical continuity through the abutting roadway segments, at or near the center of unit 26 thus, maintaining the orientation and true alignment of the roadway segments. Connector 26 provides a secure mechanical connection as well as the continuity of the electrical connections between abutting segments.

The side projecting metal conductive extension flat arms 86, 87 of conductive plates 79, 80 are slidingly engaged with conductive conductors 159, 162 in power connecting junction box 27, to provide electrical contact and continuity between the junction box and roadway power adapter connector, as seen in FIGS. 15, 9 and 1.

The power connecting junction box 27 has two socket receptacles 152 and 153, where conductive pins 154, 155 are disposed in receptacle 152 and adapted to receive a plug ended conductor of the D-C transformer 29, which is connected to pins 154, 155. Conductive pins 156, 157 are disposed in receptacle area 153 and adapted to receive a plug ended conductor of a slide wire controller 28, which is connected to pins 156, 157. The details of the electrical circuitry from junction 27 to adapter connector 26 is detailed in FIG. 9. Receptacle 152 is adapted to receive a plug from a power source, such as a step-down D-C transformer, which is, in turn, connected to a conventional source of power, such as a 110 volt power outlet. Receptacle 153 is adapted to receive a plug from a controller 28, such as the type of hand operated slide wire potentiometer generally used to control slot cars.

Figure 16:
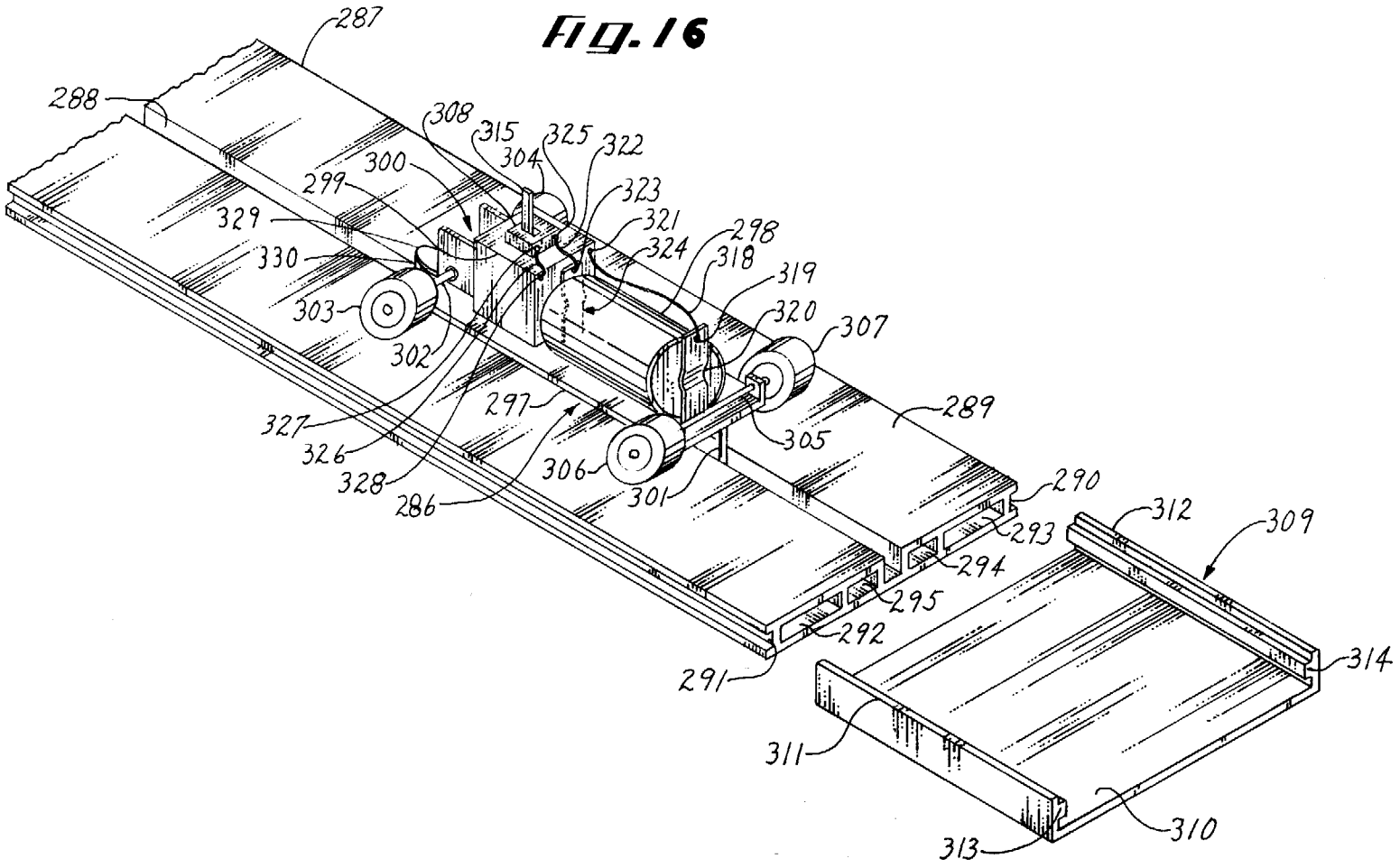
FIG. 16 is a fragmentary perspective view of a battery-powered vehicle according to the present invention.

A battery-powered version of the vehicle of the roadway of the present invention is shown in FIG. 16. As is apparent, the flexible roadway strip configuration used with this version of vehicle 286 is changed substantially by eliminating the band conductors in flanged recesses, extending along roadway upper surface.

In this embodiment, the roadway strip 287 is an extruded length of material defining a recess or channel 288, center positioned between side edges of an upper traction surface and extending longitudinally the length of the material, to act as a guideway for a guide pin 301 on vehicle 286. The guide pin extends downward from the front of chassis 297 into channel 288 for engaging either vertical side wall in a sliding, gliding manner as the vehicle is propelled along traction surface 289. Two larger passages 292, 293 and two smaller passages 294, 295 extend interiorly through length of material. A recess or channel 290, 291 extends along the full length of each side surface.

The vehicle of this embodiment of the invention comprises a chassis 297, a mounted dry cell battery 298, a D-C motor 299 engaged with a gear drive gear assembly 300, which includes a drive axle 302 having wheels 303, 304 fixedly secured on each end, for gripping roadway traction surface 289. A front axle 305 is free turning in bearings fixed on the chassis forward end and has wheels 306, 307 fixedly secured at each end, in rolling contact with the roadway.

A roadway section connector 309 shown in FIG. 16, in positioned to be connected to the end of the roadway section member 287. As seen therein, the connector consists of a flat base 310 upon which short vertical flange walls 311, 312 extend along two sides. The walls have longitudinally extending protruding runners 313, 314 located thereon. The runners are shaped and sized to fit and be slidingly received in roadway strip side channels 292, 293 for joining sections of roadway in end to end relationship.

A typical on-off toggle type switch 308 is mounted on top of motor 299. D-C electrical energy is transmitted to drive motor 299 by electrical conductor 318 from terminal 319 of battery spring clip 320 to first motor terminal 321. Conductor 322 extends from terminal 323 of a second battery spring clip 324 to the OFF position terminal 325 of toggle switch 308. A conductor 326 extends from the ON position terminal 327 of toggle switch, to second motor terminal 328.

Battery 298 is a 1.5 volt dry cell. Other electrical power packs and energy cells are also contemplated for use with this embodiment of the invention. By moving switch lever member 315 to forward position, the vehicle is caused to move forward by the electrical energy rotating motor which rotates gear assembly connected drive wheels in frictional contact with traction surface of roadway. The energy source is removed from the motor by moving the switch lever 315 rearward to the OFF position.

Restrictive skid unit 329 mounted on the rear end of the chassis, has a downwardly extending pin 330 slidingly engaged with sides of channel 288 for limiting the speeding vehicle skid around curves.

A complete and assembled roadway vehicle system is shown in FIG. 1, for illustratively demonstrating a first long length of highly flexible roadway strip 11, end mounted in adapter connector 26. A vehicle 10 mounted on roadway 11 heading away from connector 26, is shown approaching an incline upward over a hill created by a support at position 275, having an extension riser on the order of fourteen inches thus creating a fourteen inch hill for vehicle to climb. Because of the power available and good traction, the vehicles of the system are capable of climbing steep inclines and traversing small radius turns and curves. The roadway angles down from the top of the fourteen inch hill, to again be self-supporting on the floor surface. The far end of the first roadway strip is connected with a typical connector 21, at position 276, to a first typical ninety degree roadway turn section 25. A second roadway turn segment 25, is connected by a second connector 21, to the free end of the first roadway turn segment 25, at position 277. One end of a second long roadway strip 11, is connected to the free end of second roadway turn section 25, at position 278, with a third connector 21. The second long roadway section 11 is formed into hills, having valleys between, by utilizing three additional support assemblies having different length extension risers, at positions 279, 280 and 281. The free end of the second roadway 11 is connected to a third roadway turn section 25 with a fourth connector 21 at position 282. The fourth roadway turn section 25 is connected to the third roadway turn section 25 with a fifth connector 21 at position 283. The remaining free end of the fourth roadway turn section 25 is telescopically connected into the open end of adapter connector 26 at position 284 to complete and close the roadway configuration. All roadway segments have conductive bands in their respective recess channels. All roadway connectors have conductive transfer plates in contact with roadway conductor contact points, including the power adapter connector. The side extension blade conductors are in electrical contact within power connecting junction box 27. The D-C step-down transformer 29 is plugged into junction box 27 and extension cord 285 of D-C transformer is plugged into a 110 Volt connection. The hand held controller 28 is plugged into junction box 27. The controller determines the amount of power that is supplied to the electrical conductors in the flexible roadway system and thus, controls the speed and pulling power of vehicle 10. A particular advantage of the present invention is that, due to the flexibility of the thin flat roadway strip and the unique way in which the thin conductive bands are slidably supported in and mounted by the extruded roadway strip, the total assembly can be disassembled and the flat roadway flexible strips coiled on a diameter of as small as twelve inches, allowing the entire unit to be stored in a very small compact container, together with the vehicle, curve turn sections, connectors, power junction box, transformer, controller support assembly parts and any other pieces and are easily stored or packaged in a fourteen inch square by two inch deep container.

What is claimed is:

1. A roadway system comprising a length of flat material defining a straight roadway section having an endless recess extending longitudinally of said material on the flat surface centerline thereof and an endless recess including inwardly protruding flanges spaced on each side of said centerline recess, said three recesses extending the length of said material on the same flat surface, said material being relatively rigid transversally of said material and relatively flexible longitudinally of said material for ease of abrupt bending;

two lengths of flat flexible conductive strips horizontally mounted flat and confined by said flanges in each of said two spaced recesses, each said strip being freely and independently slidable in its respective recess, each said strip exposing a flat unceasing electrical contact surface, said conductive strip material being relatively thin for ease of abrupt bending;

a length of material defining a curved roadway turn section having three endless recesses extending longitudinally of said material on the same flat surface thereof, a length of flat conductive strip horizontally mounted flat and confined by inwardly protruding flanges in two of said recesses, each said strip exposing a flat unceasing electrical contact surface, said curved roadway section having a non-curved short portion at each end thereof;

an attachable means inwardly directed along each side-edge of said straight roadway section and said curved roadway section for use when attaching roadway sections together, said means extending longitudinally the length thereof;

a connector means having inwardly directed means endwise engaging with said attachable means for joining two sections of said roadway in end to end conformity;

a support means having resilient clamping means for engaging with said side-edge attachable means of said roadway sections;

a vehicle movably mounted on the flat surface of said roadway;

a motor means mounted on said vehicle conductively linked to an electrical contact means;

an electrical contact means mounted on the underside chassis of said vehicle for establishing contact with said conductive strips for transmitting electrical power from said strips to said motor means;

a drive means mounted on said chassis having wheels with thread in frictional contact with said flat surface of said roadway;

a means for transmitting mechanical drive force from said motor means to said drive means;

a laterally movable skid-limiting means mounted rearwardly on said vehicle chassis engaging with said recess of said roadway;

means for transmitting electrical power from a source of power to said conductive strips; and a guide means downwardly directed and forwardly mounted on said vehicle chassis engaging with two said recesses of said roadway.

2. A roadway system according to claim 1 wherein the attachable means comprise an endless recess inwardly directed in each side-edge of said roadway and extending the length thereof.

3. A roadway system according to claim 1 wherein the clamping means of said support means comprise resilient flat arms with upturned ends having outwardly directed push-tabs and having inwardly directed horizontal runners for clamp-on attachment along the length of said roadway, said clamping means having a downwardly directed blade-like portion slidingly-joinable with riser elements of varying length.

4. A roadway system according to claim 3 wherein each riser element comprises a length of hollow oblong tube of a pre-determined dimension, slidingly-joinable between said clamping means and a base element.

5. A roadway system according to claim 4 wherein the base element comprises a flat plate having a centrally located blade-like portion extending upwardly for joining with said riser element.

6. A roadway system according to claim 1 wherein the connector means comprise a channel-like element having a flat base portion with vertical side-walls along the length of two straight sides, said walls having inwardly directed horizontal runners slidingly-engaging with said attachable means of said roadway.

7. A roadway system according to claim 6 wherein the flat base portion of said connector means comprises two separate conductive plates fixedly mounted on the base surface and having laterally directed portions extending through said connector base side-wall and joinable with a source of power, said power being transmittable to said roadway conductive strips.

8. A roadway system according to claim 1 wherein the combined lengths of said two flat conductive strips in each recess of said two spaced recesses is a pre-determined length longer than the length of said recess in which said two strips are mounted.

9. A roadway system according to claim 8 wherein one end of one of said strips overlies the end of the other of said strips by a pre-determined distance and provides a sliding transfer of electrical power from said one strip to said other strip.

10. A roadway system according to claim 9 wherein the opposite end of said one strip is attached at a first end of said recess and the opposite end of said other strip is attached at a second end of said recess.

11. A roadway system according to claim 10 wherein the attached ends of said two strips comprise downwardly formed ends bent under said length of flat material to be flat against the underside of said roadway.

12. A roadway system according to claim 1 wherein the noncurved portion at each end of said curved roadway section comprises straight side-edges adapted for endways engagement with said connector means.

13. A roadway system according to claim 1 wherein each said recess includes flanges for overlapping and loosely confining said strips in said recesses.

14. A roadway system according to claim 1 wherein the length of flat material defining the straight roadway section comprises a one piece molded element, said element defining walls which forms the surfaces and the recesses, said walls having a uniform dimensional thickness.

15. A roadway system according to claim 14 wherein the walls of uniform dimensional thickness define a plurality of endless lengthwise passages, said walls extending the longitudinal length of said material.

16. A roadway system according to claim 1 wherein the electrical contact means comprise downwardly directed resilient conductors having blade-like electrical pickup elements edgeways slidable on said flat mounted conductive strips.

17. A roadway system according to claim 1 wherein the transverse dimension of said wheel tread being at least two times the transverse dimension of a said recess of said roadway surface on which said vehicle wheels are movably mounted.

18. A roadway system according to claim 1 wherein the laterally movable skid-limiting means comprise a pivotal mounted horizontal arm rearwardly mounted and extending on said vehicle and having a downwardly directed shaft mounted on the arm free end for engaging with a said recess, said pivotal mounted arm being free to swing transversely between vehicle mounted spaced-apart stopping means.

19. A roadway system according to claim 1 wherein the guide means comprise two downwardly directed shafts fixedly mounted forwardly on each side of the longitudinal centerline of said vehicle for engaging with said two spaced recesses for guiding said vehicle along said roadway length.

20. A roadway system comprising a length of flat material defining a roadway, said material being relatively rigid transversally of said material and relatively flexible longitudinally of said material for ease of abrupt bending;

an endless recess extending longitudinally of said material on the flat surface centerline thereof and an endless recess inwardly directed in each side-edge of said roadway material, said recesses extending longitudinally the length of the material;

a guidable vehicle movably mounted on the flat surface of said roadway, said vehicle having a mounted source of power linked to a motor means;

a drive means mechanically linked to said motor means, said drive means having wheels in frictional contact with the flat surface of said roadway, each said wheel having tread, the transverse dimension of said tread being at least two times the transverse dimension of said centerline recess; and a laterally movable skid-limiting means having a pivotal mounted horizontal arm rearwardly mounted and extending on said vehicle, said arm having a downwardly directed fixedly mounted shaft at a free end thereof, said shaft engaging with said centerline recess, said pivotal mounted arm is freely swingable transversely between vehicle mounted spaced-apart stopping means.

21. A roadway system comprising a length of flat molded one piece material defining a straight roadway section said roadway section including walls forming surfaces and recesses, said walls having a uniform dimensional thickness and defining a plurality of longitudinal passages, said material being relatively rigid transversally of the material and relatively flexible longitudinally of the material for ease of abrupt bending;

a centerline recess and a flanged recess spaced on each side of said centerline recess extending the longitudinal length of the material on the same flat side thereof, and an endless attachable recess inwardly directed in each side-edge of the material extending the length of the roadway;

two lengths of thin, flat, flexible conductive strip material horizontally mounted flat in each flanged recess said flanged recesses having flanges overlapping said strips such that said strips are freely and independently slidable in their respective recesses, the first ends of said two strips are overlapped and the second ends are secured at first and second ends of said flanged recess, said strips second ends are formed downwardly and are bent under to lay flat against the underside surface of the roadway ends;

a length of flat material defining a curved roadway section having three endless recesses extending the length of the material on the same flat surface and an endless recess inwardly directed in each side-edge of said material extending the length thereof, two of said three recessed having a length of thin, flat, and flexible conductive material horizontally mounted flat and loosely confined by overlapping flanges of said recesses;

a channel-like connector having walls along two sides of a flat base, said walls having inwardly directed horizontal runners engageable with said side-edge recesses of said roadway sections, two conductive plates having lateral portions protruding through the side wall of the connector are fixedly secured to said flat base for transmitting electrical power from a source of power to said conductive strips;

a roadway support having resilient clamping arms having upturned ends with outwardly directed push-tabs and inwardly directed horizontal runners, said runners engageable with the side-edge recesses of the roadway, said arms having downwardly directed blade-like portions slidingly engageable with a hollow oblong tubular riser element mounted on an upwardly extending blade-like portion centrally protruding from a flat base;

a vehicle movably mounted on the flat surface of the roadway, said vehicle having a chassis and a motor mounted on the chassis conductively-linked to an electrical contact means mounted on the underside of the chassis, said contact means having a downwardly directed blade-like electrical pick-up means edgewise slidable on the flat conductive strips for transmitting electrical power from said strips to the conductively-linked motor means;

a drive means mounted on the chassis mechanically-linked to means for transmitting mechanical drive force from the motor means to the drive means, said drive means having wheels with tread having a transverse dimension at least two times the transverse dimension of a said roadway recess of the flat surface on which the vehicle is movably mounted;

a skid-limiting means sideways movably mounted on the vehicle chassis which is a pivotally mounted arm horizontally extending rearwardly of the vehicle and having at the free end a downwardly directed shaft slidingly engageable with a said roadway recess, said pivotal mounted arm being freely swingable transversally between stopping means spaced apart on the chassis; and a guide means mounted forwardly on the vehicle having two downwardly directed shafts spaced apart, in gliding engagement with two said recesses for guiding the vehicle along the length of the roadway.

* * * * *